US007083400B2

(12) United States Patent
Possamai et al.

(10) Patent No.: US 7,083,400 B2
(45) Date of Patent: Aug. 1, 2006

(54) VALVE ARRANGEMENT FOR A SMALL HERMETIC COMPRESSOR

(75) Inventors: Fabricio C. Possamai, Joinville (BR); Dietmar E. Lilie, Joinville (BR)

(73) Assignee: Empresa Brasileira de Compressores S.A., Embraco Joinville (BR)

( * ) Notice: Subject to any disclaimer, the term of this patent is extended or adjusted under 35 U.S.C. 154(b) by 0 days.

(21) Appl. No.: 10/750,179

(22) Filed: Dec. 31, 2003

(65) Prior Publication Data

US 2004/0228742 A1 Nov. 18, 2004

Related U.S. Application Data

(63) Continuation of application No. 10/332,206, filed as application No. PCT/BR01/00084 on Jul. 2, 2001, now abandoned.

(30) Foreign Application Priority Data

Jul. 17, 2000 (BR) ..... 0003292

(51) Int. Cl.
*F04B 39/10* (2006.01)
*F04B 17/00* (2006.01)
*F16K 15/00* (2006.01)

(52) U.S. Cl. ..... 417/559; 417/571; 417/902; 137/512

(58) Field of Classification Search ..... 417/559, 417/569, 571, 902; 137/855, 512
See application file for complete search history.

(56) References Cited

U.S. PATENT DOCUMENTS 3,766,619 A 10/1973 Hudson, Jr. ..... 29/157.1 R
4,537,566 A * 8/1985 Blass et al. ..... 417/569
5,147,190 A * 9/1992 Hovarter ..... 417/571
5,209,260 A * 5/1993 Baek ..... 137/527
5,266,016 A * 11/1993 Kandpal ..... 417/569
5,577,898 A * 11/1996 Lee ..... 417/312
5,613,842 A 3/1997 Alfano et al. ..... 417/312
5,733,108 A 3/1998 Riffe ..... 417/542
5,762,478 A 6/1998 Lee ..... 417/312
6,006,785 A 12/1999 Iversen ..... 137/856
6,280,153 B1 * 8/2001 Iversen et al. ..... 417/312

FOREIGN PATENT DOCUMENTS

| | | |
|---|---|---|
| BR | 6793538 | 6/1975 |
| DE | 26 42 658 | 3/1977 |
| GB | 1119710 | 7/1968 |

* cited by examiner

*Primary Examiner*—Cheryl Tyler
*Assistant Examiner*—Timothy P. Solak
(74) *Attorney, Agent, or Firm*—Darby & Darby

(57) ABSTRACT

A suction and discharge valve arrangement for a small hermetic compressor of the type presenting a compression cylinder (1), which has an end closed by a valve plate (10) and which has a suction pipe (5) adjacent to the valve plate (10) and substantially orthogonal to the cylinder axis, the valve plate (10) being provided with a discharge orifice (11) substantially centralized in relation to the axial projection (20) of the internal contour of the compression cylinder (1), and with at least one suction orifice (12), which is internal to said axial projection (20) of the internal contour of the compression cylinder (1), and defining at least part of the extension of a suction passage (P), with an end opened to the inside of the compression cylinder (1) and an opposite end opened and connected to the suction pipe (5) by means of a transition portion (T), which is configured to minimize load losses.

13 Claims, 4 Drawing Sheets

VALVE ARRANGEMENT FOR A SMALL HERMETIC COMPRESSOR

This application is a continuation of application Ser. No. 10/332,206 filed Jan. 3, 2003, now abandoned, which is a National Stage of PCT/BR01/00084, filed Jul. 2, 2001, which claims priority to Brazil PI0003292-1, filed July. 17, 2000. has been inserted.

FIELD OF THE INVENTION

The present invention refers to a suction and discharge valve arrangement for a hermetic compressor of the type used in small refrigerating appliances, such as refrigerators, freezers, water fountains, etc.

BACKGROUND OF THE INVENTION

The energetic efficiency of the small hermetic compressors of refrigeration is greatly attributed to the good performance of its valves in the control of the gas flow.

Refrigeration compressors for domestic use employ one-way valves that control the gas flow during operation. A suction valve controls the gas flow, which comes from the suction line connected to the low pressure side of the refrigeration system, and which is drawn through the compression cylinder, while a discharge valve controls the gas already compressed, to be directed to the high pressure side of the refrigeration system.

The suction and discharge valves usually comprise one or more orifices for gas passage, and vanes affixed by one of the ends thereof, so that upon occurring a pressure differential through the valve, the vane is displaced, allowing the gas to pass in the preferred required direction.

In order to facilitate the manufacturing process, said suction and discharge orifices usually have a circular cross section and are constructed in a steel plate known as the valve plate. In most cases and mainly when the hermetic compressor has a small size, the geometrical shape of the suction valve and of the suction and discharge orifices, as well as the requirement of insulating the already compressed gas from the gas that is at suction pressure (such requirement being mainly fulfilled by the cylinder cover), forces the discharge orifice to be positioned eccentrically in relation to the axis of the center of the compression cylinder, being very close to the wall of said cylinder (FIG. 1), so that the suction orifice may also be contained within the axial projection of the internal contour of the compression cylinder, maintaining a certain minimum spacing in relation to the discharge orifice.

However, during discharge, it is necessary to supply the gas with an additional power, in order to overcome the energy losses in the valve and in the discharge muffler before flowing to the refrigeration system. This additional power may be called over-pressure power and decreases the energetic efficiency of the compressor. In this situation, the piston is very close to the upper dead point of the mechanism, resulting in a compression chamber with small height, which greatly increases the load loss of the gas that has to flow to the discharge orifice and then flow through the discharge valve. The more eccentric the position of the discharge orifice, the greater will be the loss. An example of this occurrence is described in Brazilian patent application PI 6,793,538, where such effects are discussed in relation to irregular loads imparted to the vanes, affecting the reliability thereof. However, in this prior solution, since the compressor is not small, the discharge orifice may be positioned in the center of the compression chamber.

In the construction of large and medium size compressors, in the region of the cylinder cover, there is enough space to provide a change in the direction of the gas flowing from the suction pipe to the suction orifice, by means of a curve with a radius and a cross section, which are required for allowing the whole cross sectional area of the suction orifice to be fully and homogenously used by the gas flow coming from the suction pipe. The curvature imparted to the gas flow upon passing from the suction pipe to the suction orifice, or orifices, may be achieved so that the whole cross section of the suction orifice is adequately used for gas flow passage.

Besides the situations in which there is availability of space, as mentioned above, it should be noted that in the solutions such as that described in PI 6,793,538, a suction chamber is provided in the cylinder head, directly opened to the suction orifice, eliminating the problem of a sudden change in the direction of the gas flowing from the suction pipe directly to the suction orifice or orifices.

During compression, the suction valve is submitted to a load which is calculated by (Pcil−Ps)Ao, where Pcil is the pressure in the cylinder, Ps the evaporation pressure and Ao is the area of the orifice. In the know solution of vane constructions for a suction valve, the vane bends over the suction orifice and is submitted to a bending stress, which, when superior to a limit fatigue stress of the vane material, makes the valve break due to bending fatigue. The stress over the vane is a function of the shape of the orifice. The circular orifice results in higher stress over the valve, exactly in the central point, because this point is equidistant from the seating regions.

SUMMARY OF THE INVENTION

Thus, it is an object of the present invention to provide a suction and discharge valve arrangement for a small hermetic compressor, which allows positioning the discharge orifice in the valve plate in a way that minimizes the pressure differentials existing in the known prior art constructions, reducing the power dissipation and load loss during compression, without impairing the gas flow effective area through the suction orifice, as well as the minimum spacing of the latter in relation to the discharge orifice.

This and other objects are achieved through a suction and discharge valve arrangement for a small hermetic compressor of the type presenting a compression cylinder, which has an end closed by a valve plate and which is supplied by a suction pipe disposed adjacent to the valve plate and substantially orthogonal to the cylinder axis, the valve plate being provided with a discharge orifice substantially centralized in relation to the axial projection of the internal contour of the compression cylinder, and with at least one suction orifice, which is internal to said axial projection of the internal contour of the compression cylinder and external to the contour of the discharge orifice, in order to maintain with the latter a certain minimal spacing, and defining at least part of a suction passage with an end opened to the inside of the compression cylinder and an opposite end opened to the suction pipe, by means of a transition portion, which is incorporated to one of the parts defined by the suction passage and the suction pipe, and with a cross section configured to impart to the gas flow a change of direction, which allows the whole cross sectional area of the suction orifice to be fully used for gas flow passage.

BRIEF DESCRIPTION OF THE DRAWINGS

The invention following will be described below, with reference to the attached drawings, in which.

DESCRIPTION OF THE ILLUSTRATED EMBODIMENT

Figure 1:
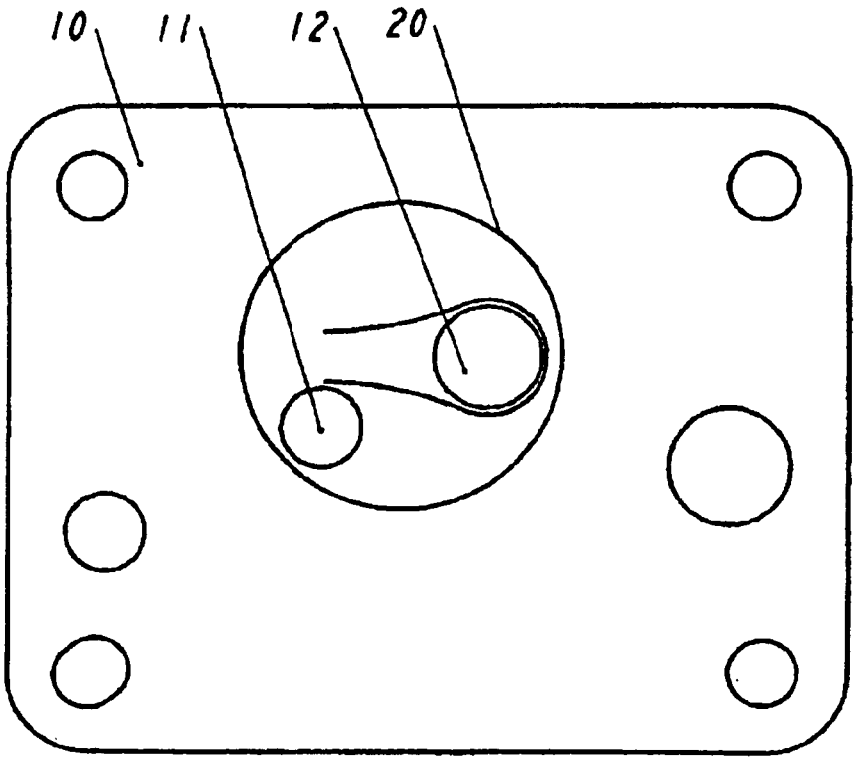
FIG.1 PRIOR ART
FIG. 1 shows, schematically, a plan view of a valve plate when observed from the side of the compression cylinder and illustrating a suction valve and the suction and discharge orifices constructed according to the prior art.
Figure 2:
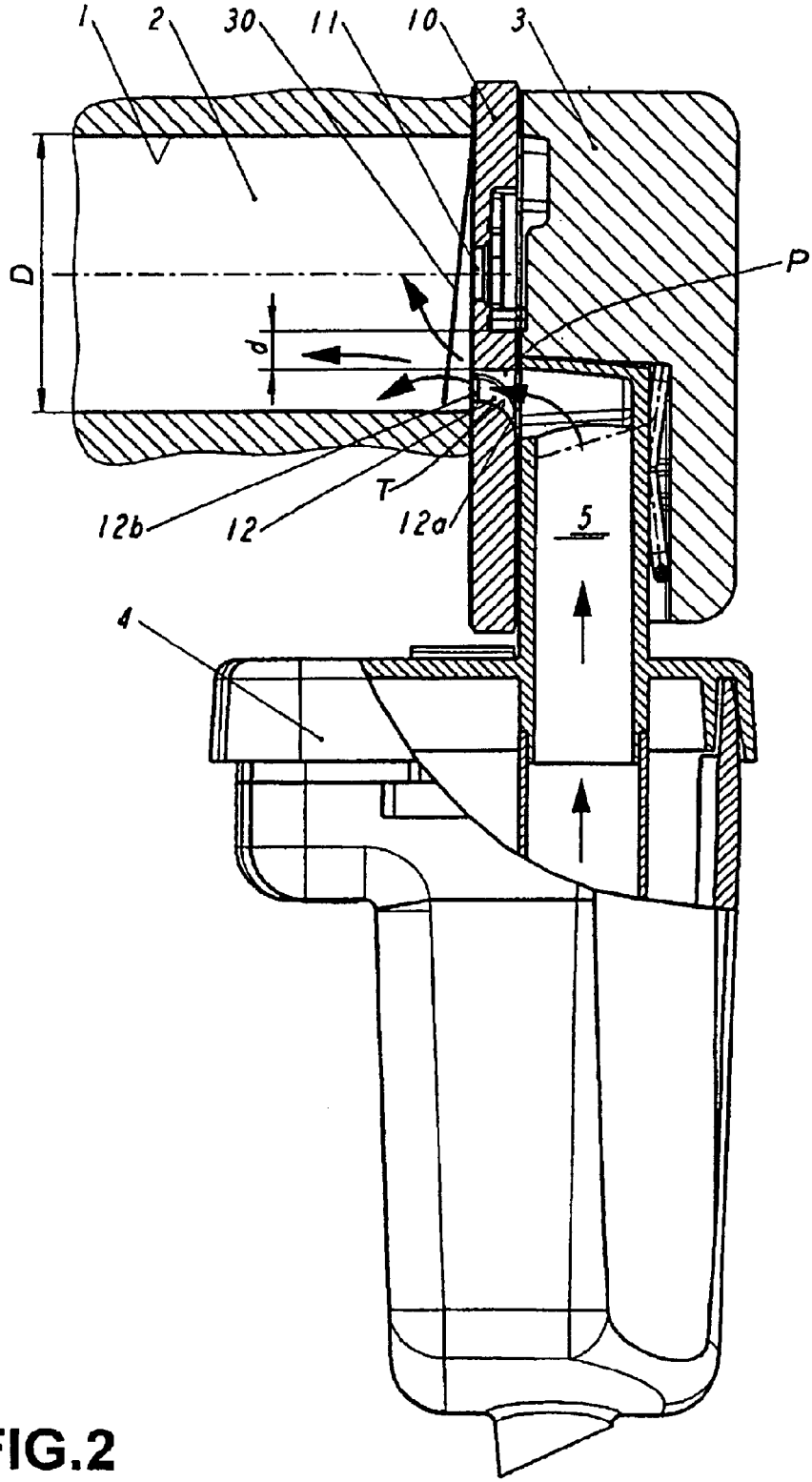
FIG. 2 shows, schematically, a longitudinal sectional view of a valve plate of the valve arrangement of the present invention coupled to a cylinder cover and to a suction muffler.
Figure 3:
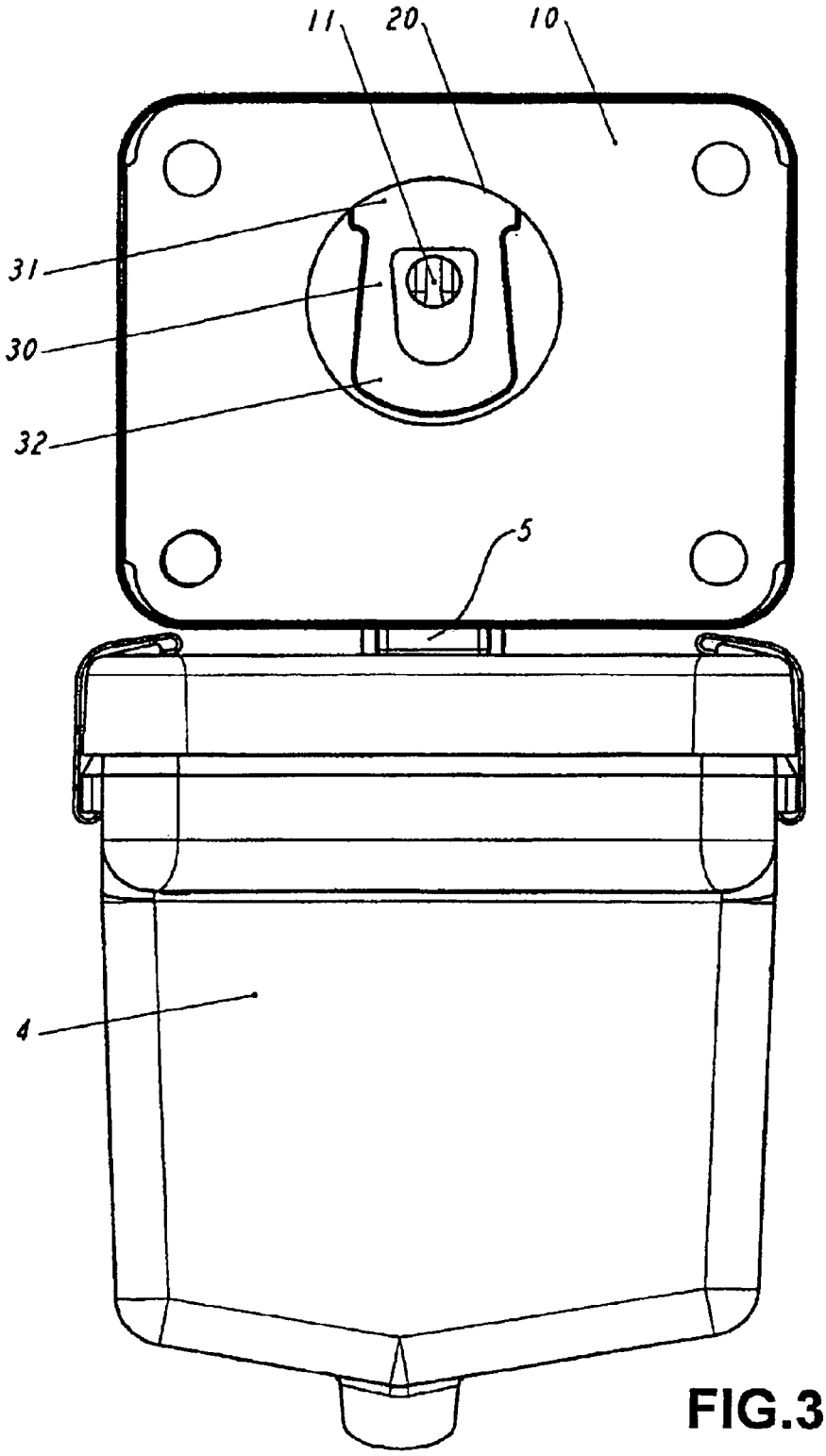
FIG. 3 shows, schematically, a plan view of a valve plate of the valve arrangement of the present invention when coupled to the suction muffler illustrated in FIG. 2.

The present invention will be described in relation to a hermetic compressor of small size comprising, inside a non-illustrated shell, a motor-compressor assembly including a cylinder block defining a compression cylinder 1, inside which is lodged a reciprocating piston, drawing and compressing the refrigerant gas when driven by an electrical motor of the motor-compressor assembly. The compression cylinder 1 has an end closed by a valve plate 10, which is affixed to said cylinder block and provided with a discharge orifice 11 and at least one suction orifice 12, a compression chamber 2 being defined inside the compression cylinder 1, between the piston top and the valve plate 10. The cylinder block further carries a cylinder cover 3, which is affixed to the valve plate 10, so as to insulate the high pressure side from the low pressure side, and which defines, internally, suction and discharge chambers (not illustrated), which are respectively maintained in selective fluid communication with the compression chamber 2 through the discharge orifice 11 and suction orifice 12. This selective communication is defined by the opening and closing of suction and discharge valves, both in the form of a valve vane, each acting in the respective suction orifice 12 and discharge orifice 11. The valve plate 10 further carries a suction muffler 4 (FIGS. 2 and 3).

In the constructions of small compressors, such as described herein, through the cylinder cover 3 is defined a suction pipe 5 disposed adjacent to the valve plate 10 and substantially orthogonal to the cylinder axis and which in the illustrated construction is defined by the pipe that supplies gas to the suction orifice 12 through the cylinder cover. According to the illustration, the suction pipe is coupled to the suction muffler 4.

According to the present invention, the valve plate 10 has the discharge orifice 11 substantially centralized in relation to an axial projection 20 (with diameter D) of the internal contour of the compression cylinder 1 on said plate, and at least one suction orifice 12 disposed internal to said axial projection 20 of the internal contour of the compression cylinder 1 and external to the contour of the discharge orifice 11, in order to maintain with the latter a certain minimal radial spacing "d", which is defined at least on a face of said valve plate 10 turned to the inside of the compression cylinder 1, and which is calculated in order to form a wall thickness that may adequately press a sealing gasket, in order to avoid the undue escape of gas from the high pressure side to the low pressure side.

The distance between said orifices on each side of the valve plate 10 is determined so as to obtain a larger sealing area between the suction side and the discharge side. In the illustrated construction, the radial distance between the adjacent contours of the discharge orifice 11 and suction orifice 12 in another face opposite to that turned to the inside of the compression cylinder 1 is, for instance, inferior to the certain minimal spacing "d".

According to the present invention, the discharge orifice 11 is circular and coaxial to the internal contour of the compression cylinder 1, and the suction orifice 12 is in the form of an annular sector of smaller dimension d1 and larger dimension d2, substantially concentric to at least one of the internal contours of the compression cylinder 1 and discharge orifice 11.

In the illustrated embodiment, the suction orifice 12 integrally defines a suction passage P having an end opened to the inside of the compression cylinder 1 and an opposite end, which is opened and connected to the suction pipe 5 by means of a transition portion T, generally in the form of a duct portion, which is at least partially bent in the internal profile thereof and incorporated to one of the parts defined by the suction passage P and suction pipe 5, and which has a cross section configured in order to impart to the gas flow coming from the suction pipe 5 a change of direction, which is adequate and necessary for maintaining the whole cross sectional area of the suction orifice 12 fully used for the gas flow passage.

In the solution being described, the transition portion T is defined by the end of the suction orifice 12 itself facing the suction pipe 5, with a cross section configured in order to maximize the radius of curvature of the change of direction to which the gas flow is submitted in said transition portion T, upon passing from the suction pipe 5 to the suction passage P which, in the illustrated configuration, is integrally defined by the suction orifice 12 disposed through the valve plate 10.

According to the present invention, the cross sectional area of the transition portion T, which is defined by the suction orifice 12 itself as mentioned above, is better used, since it allows the gas being admitted to follow the curvature, which is necessary to maximize the use of the cross sectional area of the suction orifice 12.

In a variation of the present solution, not illustrated, the configuration of the transition portion T, in order to provide the desired curvature for the gas flow being admitted to the inside of the compression cylinder 1, may be obtained in the suction pipe 5 itself, in the suction muffler 4, or even in the cylinder cover 2. In another constructive option, the curvature of the path of the gas flowing towards the inside of the compression cylinder 1 may be obtained by a step provided anterior to the suction orifice 12, in the internal part of the transition portion T defined by the gas inlet end 12*a* of the suction orifice 12.

According to the illustration, the suction orifice 12 has the gas inlet end 12*a*, which defines the transition portion T, opened to the face of the valve plate 10 opposite to that turned to the inside of the compression cylinder 1 and directly connected to the suction pipe 5, and a gas outlet end 12*b*, opened to the face of the valve plate 10, which is turned to the inside of the compression cylinder 1.

In the solution of the present invention, the suction orifice 12 provided in the valve plate 10 no more presents a cylindrical contour and a wall with a constant dimension along the thickness of the valve plate 10.

According to the illustrations, the suction orifice 12 has its gas inlet end 12*a*, which defines the transition portion T, with a cross section larger than that of the gas outlet end 12*b* and further presenting part of its wall, which is defined through the thickness of the valve plate 10, arcuated and converging in part of its contour, forming a gas receiving funnel, making less abrupt the change of direction of the gas flow reaching the valve plate 10 in this region, and consequently minimizing the load losses resulting from the abrupt change of direction of the gas flow from the suction pipe 5 to the inside of the suction orifice 12 in the valve plate 10.

The suction orifice 12 presents a shape and dimensions defined as a function of the axial projection of the contour of the compression cylinder 1 and in order to optimize the gas flow through the valve plate 10, without resulting in high load loss, and which allows providing the minimum distance "d" between its contour adjacent to the contour of the discharge orifice 11.

The suction orifice 12 of the present invention has the following main advantages: higher effective areas of gas flow for the same geometrical area of gas passage; substantial use of the geometrical area of the suction orifice 12, even in situations in which the gas supply from the suction pipe is made perpendicular and close to the suction orifice 12; and optimization of the relation between the area of the suction orifice 12 and the thickness of the valve vane, allowing to reduce the dissipation of power in the suction valve.

According to the present invention, the valve plate 10 has attached, on its face turned to the inside of the compression cylinder 1, a suction valve vane 30, by means of an end portion 31 of the latter, said suction valve vane 30 having another end portion 32, which is displaced, by elastic deformation, between a closed valve position, blocking the suction orifice 12, and an open valve position, liberating said suction orifice 12, said suction valve vane 30 being located inside the axial projection 20 of the internal contour of the compression cylinder 1 and outside the axial projection of the contour of the discharge orifice 11. According to the illustrations, the suction valve vane 30 presents a substantially "U" shaped contour, in which the base of said "U" defines the other end portion 32, said end portions 31 and 32 being opposite to each other and located in regions of the valve plate 10 diametrically opposite in relation to the contour of the discharge orifice 11. The proposed solution presents a new geometry for the suction orifice 12, which allows positioning the discharge orifice 11 as close as possible to the central region of the compression cylinder 1.

The importance of centralizing the discharge orifice 11 is due to the fact that the discharge of the compressed gas occurs while the piston is very close to the upper dead point of the mechanism. In this case, the centralization of the discharge orifice 11 reduces the pressure differentials along the compression cylinder 1, during the period of time in which the discharge of the compressed gas is occurring through the discharge valve. The reduction of these pressure differentials results directly in less power being dissipated during compression, which promotes a higher energetic efficiency to the compressor.

Figure 4:
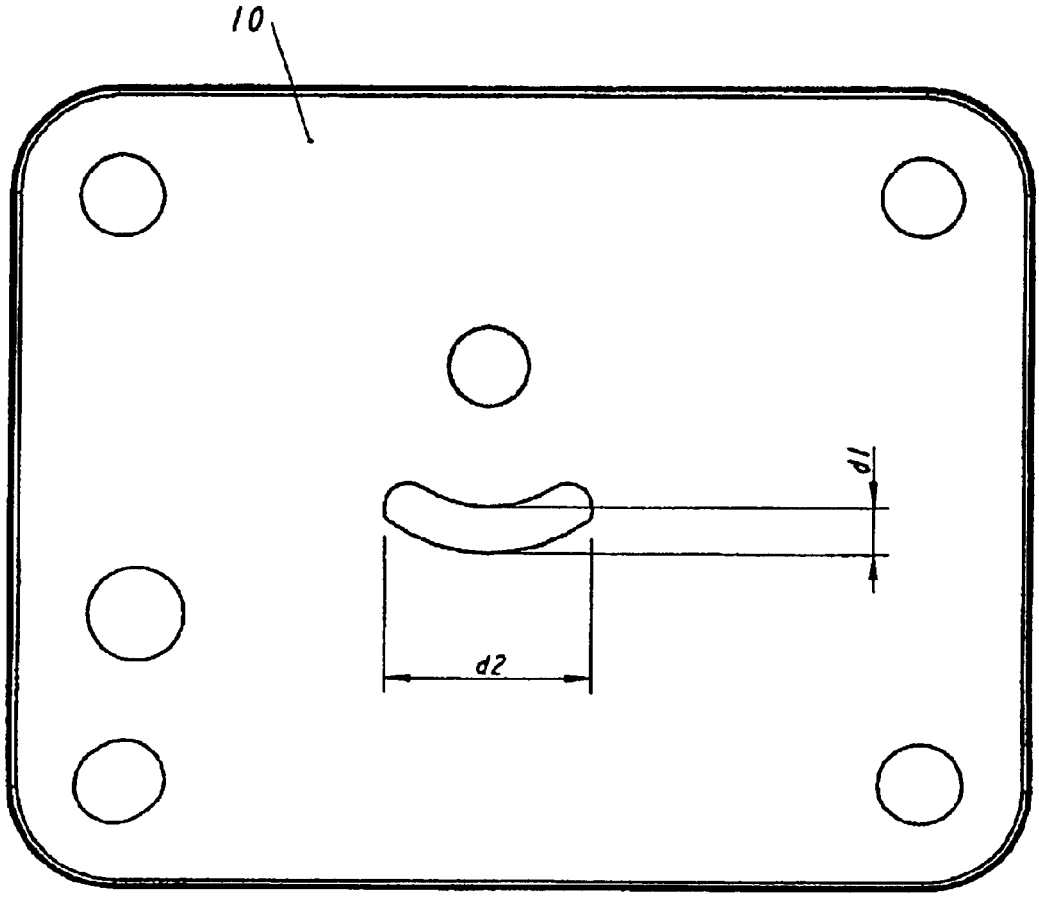
FIG. 4 shows, schematically, a plan view similar to that of FIG. 1, but illustrating the valve plate of FIG. 3 without the suction valve.

The "U" shape of the suction valve, for instance with a small inlet radius, as presented in FIGS. 3 and 4, allows to modify the geometry of the suction orifice 12, whose optimized illustrated form (and which follows the gas flow) has a cross section that produces an effect on the gas flow coming from the suction muffler 4, submitting it to a curvature of about 90° before passing through the suction orifice.

As a function of the geometry of the suction orifice of the present invention, the suction valve vane may present a reduced thickness in relation to the known prior art vanes, maintaining the same reliability and reducing the losses during suction. These advantages are reached, since the present solution allows to minimize the bending stresses over the suction valve vane in the region of the suction orifice during discharge.

In the present construction, the suction valve vane is substantially seated on the edges which define the suction orifice 12 and which are radially spaced from each other by the distance d1. Thus, even having d2>D, for instance, the final stress on the valve will be lower, when compared to a suction orifice of cylindrical shape.

With the present construction for the suction orifice, there is obtained a reduction in the maximum bending stress of the suction valve vane in the region of the orifice in relation to the maximum stress foreseen for a cylindrical orifice, allowing the use of valve vanes with smaller thickness, which reduces the dissipation of power in this component during suction and increases the energetic efficiency.

What is claimed is:

1. A suction and discharge valve arrangement for a small hermetic compressor of the type presenting a compression cylinder, which has an end closed by a valve plate, and which is supplied by a suction pipe disposed adjacent to the valve plate and substantially orthogonal to the cylinder axis, characterized in that the valve plate comprises:

a discharge orifice substantially centralized in relation to an axial projection of the internal contour of the compression cylinder, at least one suction orifice, which is:

internal to said axial projection of the internal contour of the compression cylinder and external to a contour of the discharge orifice, and occupying an annular sector substantially concentric to at least one of the internal contour of the compression cylinder and discharge orifice in order to maintain with the discharge orifice a certain minimum spacing and defining at least part of a suction passage, with an end opened to the inside of the compression cylinder and an opposite end opened and connected to the suction pipe, via a transition portion, which is incorporated to one of the parts defined by the suction passage and the suction pipe, and with a cross section configured to impart to the gas flow a change of direction, which allows the whole cross sectional area of the suction orifice to be fully used for gas flow passage.

2. Arrangement, according to claim 1, characterized in that the transition portion defines a duct portion connecting the suction pipe to the suction passage and being at least partially bent in its internal profile.

3. Arrangement, according to claim 2, characterized in that the transition portion is incorporated to the suction passage.

4. Arrangement, according to claim 3, characterized in that the suction portion is defined by the suction orifice itself, presenting a gas inlet end coupled to the suction pipe and a gas outlet end opened to the inside the compression cylinder.

5. Arrangement, according to claim 4, characterized in that the transition portion is defined by the gas inlet end of the suction orifice, which is curved in part of its contour in order to define a profile for gas admission.

6. Arrangement, according to claim 4, characterized in that the valve plate affixes, on its face turned to the inside of the compression cylinder, one of the end portions of a suction valve vane, with its other end portion being displaced, by elastic deformation of the vane, between a closed valve position, blocking the suction orifice, and an open valve position, liberating said suction orifice, said suction valve vane being located inside the axial projection of the internal contour of the compression cylinder and outside the axial projection of the contour of the discharge cylinder.

7. Arrangement, according to claim 6, characterized in that the end portions of the suction valve vane are opposite to each other and located in regions of the valve plate that are diametrically opposite in relation to the contour of the discharge orifice.

8. Arrangement, according to claim 7, characterized in that the suction valve vane presents a substantially "U" shaped contour.

9. Arrangement, according to claim 1, characterized in that the suction orifice is in the shape of an annular sector substantially concentric to at least one of the internal contours of the compression cylinder and discharge orifice.

10. Arrangement, according to claim 1, characterized in that the discharge orifice is circular and coaxial to the internal contour of the compression cylinder.

11. A suction and discharge valve arrangement for a small hermetic compressor of the type presenting a compression cylinder, which has an end closed, by a valve plate and which is connected to a suction pipe disposed adjacent to the valve plate and substantially orthogonal to a cylinder axis, wherein the valve plate comprises:

a discharge orifice, and at least one suction orifice disposed internal to an axial projection of an internal contour of the compression cylinder and external to a contour of the discharge orifice, wherein the at least one suction orifice comprises an end opened to the inside of the compression cylinder and an opposite end opened and connected to the suction pipe via a transition portion which is incorporated to the valve plate, said transition portion having a cross section configured to impart to the gas flow a change of direction which allows the whole cross sectional area of the suction orifice to be fully used for gas flow passage.

12. The valve arrangement of claim 11, wherein the at least one suction orifice occupies an angular sector substantially concentric to at least one of the internal contour of the compression cylinder and discharge orifice in order to maintain with the discharge orifice a certain minimum spacing and defining at least part of a suction passage.

13. The valve arrangement of claim 12, wherein the discharge orifice is provided substantially centralized in relation to an axial projection of the internal contour of the compression cylinder.

* * * * *